US011749167B2

(12) United States Patent
Park et al.

(10) Patent No.: US 11,749,167 B2
(45) Date of Patent: Sep. 5, 2023

(54) DATA DRIVE CIRCUIT, CLOCK RECOVERY METHOD OF THE SAME, AND DISPLAY DRIVE DEVICE HAVING THE SAME

(71) Applicant: LX SEMICON CO., LTD., Daejeon (KR)

(72) Inventors: Jong Hwi Park, Daejeon (KR); Gi Baek Choi, Daejeon (KR); Yong Jung Kwon, Daejeon (KR); Jung Bae Yun, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/550,664

(22) Filed: Dec. 14, 2021

(65) Prior Publication Data

US 2022/0198989 A1 Jun. 23, 2022

(30) Foreign Application Priority Data

Dec. 18, 2020 (KR) ..... 10-2020-0178114

(51) Int. Cl.
*G09G 3/20* (2006.01)

(52) U.S. Cl.
CPC ... *G09G 3/2092* (2013.01); *G09G 2310/0275* (2013.01); *G09G 2310/061* (2013.01); *G09G 2310/08* (2013.01)

(58) Field of Classification Search
CPC ..... G09G 3/2092; G09G 2310/0275; G09G 2310/061; G09G 2310/08; G09G 2370/08; G09G 5/008; G09G 3/20; G09G 3/3648; G09G 3/3225
See application file for complete search history.

(56) References Cited

U.S. PATENT DOCUMENTS 8,362,997 B2 * 1/2013 Huang ..... G09G 3/20 345/99
10,714,051 B1 * 7/2020 Huang ..... G09G 3/20
(Continued)

FOREIGN PATENT DOCUMENTS

KR 10-2113618 B1 6/2015
KR 10-2260328 B1 5/2016
KR 10-2019-0014274 A 2/2019

*Primary Examiner* — Jose R Soto Lopez
(74) *Attorney, Agent, or Firm* — ROTHWELL, FIGG, ERNST & MANBECK, P.C.

(57) ABSTRACT

The present disclosure relates to a data drive circuit capable of increasing clock and data recovery stability by generating a clock synchronized with input data, a clock recovery method thereof, and a display drive device having the same, and the data drive circuit according to an aspect includes a receiver including a clock and data recovery part configured to recover a test data pattern from input data using an internal clock, and a data comparator configured to compare the recovered test data pattern with a predetermined reference data pattern to generate a control signal according to a degree of asynchronicity between the recovered test data pattern and the reference data pattern, wherein the clock and data recovery part recovers a clock synchronized with the input data according to the control signal, and recovers control information and image data from the input data using the recovered clock.

20 Claims, 7 Drawing Sheets

(56) References Cited

U.S. PATENT DOCUMENTS

| | | | | |
|---|---|---|---|---|
| 2011/0110412 | A1* | 5/2011 | Shin | H04L 25/0272 375/224 |
| 2011/0286562 | A1* | 11/2011 | Jeon | H03L 7/0816 375/371 |
| 2011/0292099 | A1* | 12/2011 | Kim | G09G 3/3614 345/99 |
| 2013/0113777 | A1* | 5/2013 | Baek | G09G 5/008 345/212 |
| 2013/0128124 | A1* | 5/2013 | Suzuki | G09G 5/008 348/725 |
| 2015/0067392 | A1* | 3/2015 | Lim | G09G 3/20 714/15 |
| 2019/0158100 | A1* | 5/2019 | Lim | H03L 7/0805 |
| 2020/0160817 | A1* | 5/2020 | Kim | G09G 3/2096 |
| 2020/0279533 | A1* | 9/2020 | Fan | G09G 5/12 |
| 2021/0109561 | A1* | 4/2021 | Moon | G06F 1/10 |
| 2021/0111724 | A1* | 4/2021 | Jung | H03L 7/099 |
| 2021/0184682 | A1* | 6/2021 | Tak | H03L 7/091 |
| 2021/0328757 | A1* | 10/2021 | Kim | H04L 7/02 |
| 2021/0351908 | A1* | 11/2021 | Kobayashi | G11C 16/32 |
| 2022/0069828 | A1* | 3/2022 | Pang | G01R 25/00 |
| 2022/0148515 | A1* | 5/2022 | Hong | G09G 5/006 |

* cited by examiner

DATA DRIVE CIRCUIT, CLOCK RECOVERY METHOD OF THE SAME, AND DISPLAY DRIVE DEVICE HAVING THE SAME

CROSS-REFERENCE TO RELATED APPLICATIONS

This application claims the benefit of the Korean Patent Application No. 10-2020-0178114 filed on Dec. 18, 2020, which is hereby incorporated by reference as if fully set forth herein.

FIELD OF THE INVENTION

The present disclosure relates to a data drive circuit capable of increasing clock and data recovery stability by generating a clock synchronized with input data, a clock recovery method thereof, and a display drive device having the same.

BACKGROUND

Display devices include a panel configured to display an image through a pixel matrix, a gate driver configured to drive gate lines of the panel, a data driver configured to supply a data signal to data lines of the panel, a timing controller configured to control the gate driver and the data driver, and the like. The data driver includes a plurality of data drive integrated circuits (ICs) configured to divide and drive the data lines.

The timing controller may serialize parallel data and transmit the serialized data to the plurality of data drive ICs, and each of the plurality of data drive ICs may recover and use clock and data information from a transmission signal.

In a case in which the timing controller and the data drive ICs are systems that transmit and receive an N-bit data string, the plurality of data drive ICs may generate clocks of N phases, and signals having N different delays may be generated at different receivers. In this case, from a system point of view, there is difficulty in controlling N different asynchronous signals, and when the input data is asynchronous with the clock, it is difficult for the receiver to accurately recover the received information.

SUMMARY

The present disclosure is directed to providing a data drive circuit capable of increasing clock and data recovery stability by generating a clock synchronized with input data, a clock recovery method thereof, and a display drive device having the same.

According to an aspect of the present disclosure, there is provided a data drive circuit including a receiver including a clock and data recovery part configured to recover a test data pattern from input data using an internal clock, and a data comparator configured to compare the recovered test data pattern with a predetermined reference data pattern to generate a control signal according to a degree of asynchronicity between the recovered test data pattern and the reference data pattern, wherein the clock and data recovery part may recover a clock synchronized with the input data according to the control signal, and recover control information and image data from the input data using the recovered clock.

According to another aspect of the present disclosure, there is provided a clock recovery method of a data drive circuit, the method including recovering a test data pattern from input data using an internal clock, comparing the recovered test data pattern with a predetermined reference data pattern to generate a control signal according to a shift amount between the recovered test data pattern and the reference data pattern, and recovering a clock synchronized with the input data by selecting any one clock from among a plurality of clocks, which have different phases, included in the internal clock according to the control signal.

The method may further include, before the recovering of the test data pattern, generating the internal clock including a first clock and a second clock, wherein in the generating of the internal clock, the first clock whose phase is locked in synchronization with the clock training pattern transmitted from the timing controller may be generated, the first clock may be divided to have a period the same as that of an N-bit image data string (where N is an integer equal to or greater than two) to generate N divided clocks having different phases, and one of the divided clocks may be output as the second clock.

The recovering of the test data pattern may include shifting the input test data pattern in a serial form, which is supplied as the input data, according to the first clock, and recovering the test data pattern by latching the shifted test data pattern according to the second clock and outputting the latched test data pattern in a parallel form.

The generating of the control signal may include comparing the recovered test data pattern with the reference data pattern and detecting the number of shifted bits of the recovered test data pattern in comparison with the reference data pattern as the shift amount, and generating the control signal for selecting the second clock from among the N divided clocks according to the detected shift amount.

According to still another aspect of the present disclosure, there is provided a display drive device including a timing controller including a transmitter, and a plurality of data drive circuits each including a receiver connected to the transmitter of the timing controller through each transmission channel, wherein the receiver may include a clock and data recovery part configured to recover a test data pattern from input data transmitted from the transmitter using an internal clock, and a data comparator configured to compare the recovered test data pattern with a predetermined reference data pattern to generate a control signal according to a shift amount between the recovered test data pattern and the reference data pattern, wherein the clock and data recovery part may recover a clock synchronized with the input data according to the control signal, and recover control information and image data from the input data using the recovered clock.

The clock and data recovery part may include a clock generator configured to generate and output the first clock whose phase is locked in synchronization with a clock training pattern transmitted from the transmitter, divide the first clock to have a period the same as that of an N-bit image data string (where N is an integer equal to or greater than two), generate N divided clocks having different phases, and select and output a second clock from among the divided clocks according to the control signal of the data comparator, and a deserializer configured to convert the input data in a serial form into parallel data using the first clock and the second clock and output the parallel data.

The deserializer may recover the test data pattern by shifting the input test data pattern in a serial form, which is supplied as the input data, according to the first clock, latching the shifted test data pattern according to the second clock, and outputting the latched test data pattern in a parallel form.

The deserializer may include a first register including N first flip-flops connected in series to a data input line, and configured to shift the input test data pattern, which is input in units of an N-bit string, according to the first clock, and a second register including N second flip-flops connected in parallel to the N first flip-flops, and configured to latch the test data pattern of N bits, which is from the first register, according to the second clock and output the latched test data pattern in a parallel form.

The data comparator may compare the recovered test data pattern with the reference data pattern, detect the number of shifted bits of the recovered test data pattern in comparison with the reference data pattern as the degree of asynchronicity, generate the control signal for selecting the second clock of the N divided clocks according to the detected degree of asynchronicity, and output the control signal to the clock generator.

The receiver may generate the internal clock using a clock training pattern in a serial form transmitted from the transmitter during a first period, restore the test data pattern in a serial form, which is transmitted from the transmitter without a clock during a second period, to the test data pattern in a parallel form using the internal clock, and recover a clock synchronized with the input data using the restored test data pattern, restore the control information in a serial form, which is transmitted from the transmitter without a clock during a third period, to the control information in a parallel form using the recovered clock, and restore the image data in a serial form, which is transmitted from the transmitter without a clock during a fourth period, to the image data in a parallel form using the recovered clock.

The first period and the second period may be included in an initial driving period before the image data of each frame is supplied, the third period may be included in a blank period of each frame, the fourth period may be included in an active period of each frame, and the first and second periods may be further included before the third period of the blank period of each frame.

The receiver may further include a reception buffer configured to receive a transmission signal in the form of a differential signal, convert the transmission signal into the input data, and output the input data to the clock and data recovery part.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Figure 1:
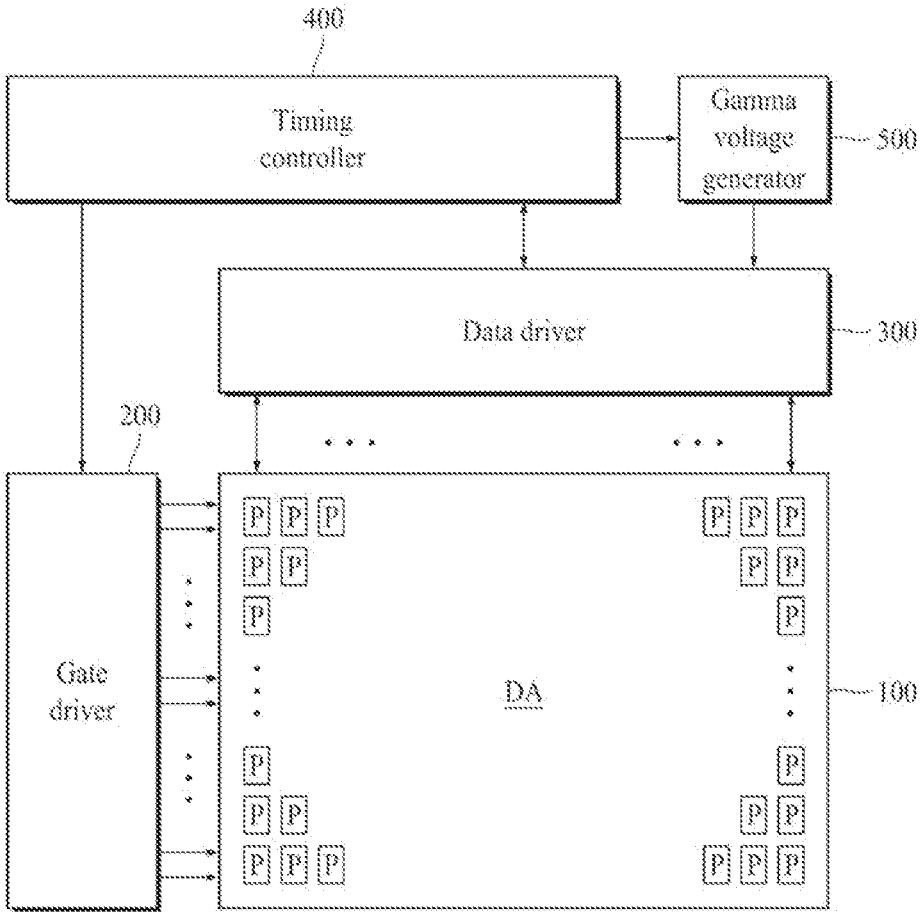
FIG. 1 is a block diagram illustrating a configuration of a display device according to one embodiment.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as "on," "over," "under," and "next," one or more other parts may be disposed between the two parts unless a more limiting term, such as "just" or "direct(ly)" is used.

In describing a time relationship, for example, when the temporal order is described as, for example, "after," "subsequent," "next," and "before," a case which is not continuous may be included unless a more limiting term, such as "just," "immediate(ly)," or "direct(ly)" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, the terms "first," "second," "A," "B," "(a)," "(b)," etc., may be used. These terms are intended to identify the corresponding elements from the other elements, and basis, order, or number of the corresponding elements should not be limited by these terms. The expression that an element is "connected," "coupled," or "adhered" to another element or layer, the element or layer can not only be directly connected or adhered to another element or layer, but also be indirectly connected or adhered to another element or layer with one or more intervening elements or layers "disposed" between the elements or layers, unless otherwise specified.

The term "at least one" should be understood as including any and all combinations of one or more among the associated listed elements. For example, the meaning of "at least one or more of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, exemplary embodiment of the present disclosure will be described in detail with reference to the drawings.

Figure 2:
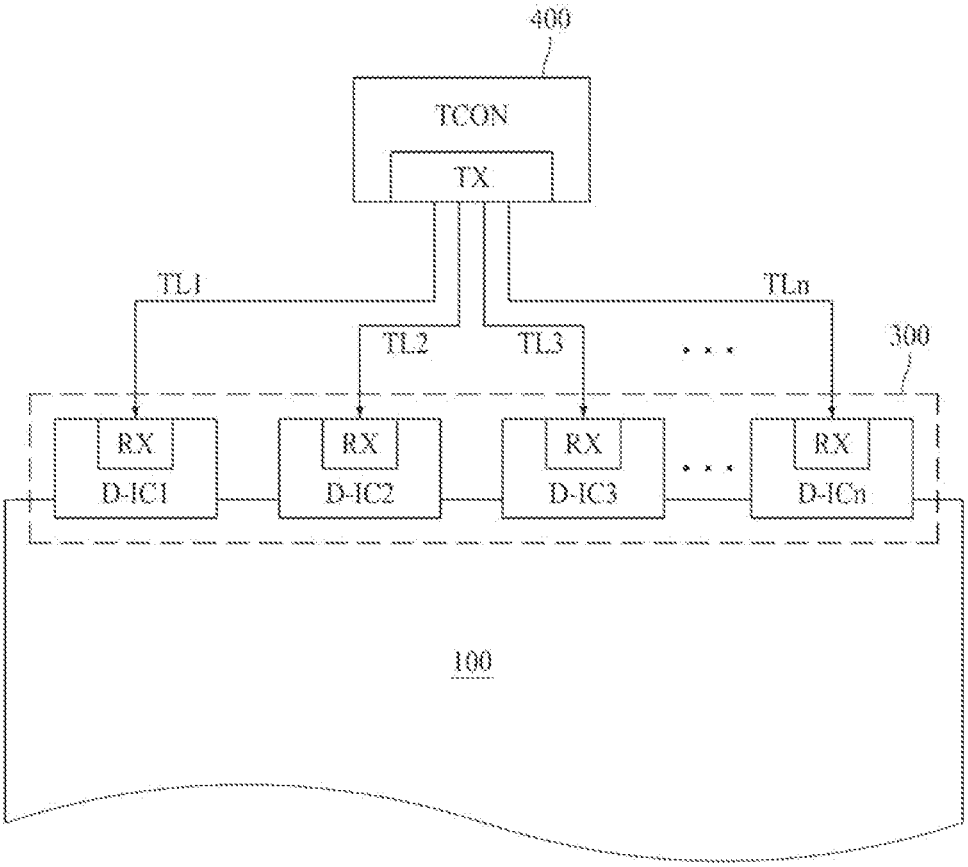
FIG. 2 is a block diagram illustrating a display drive device according to one embodiment of the present disclosure.

FIG. 1 is a block diagram schematically illustrating a configuration of a display device according to one embodiment, and FIG. 2 is a block diagram illustrating a display drive device including a plurality of data drive integrated circuits (ICs) and a timing controller according to one embodiment.

The display device according to one embodiment may be any one of various display devices including a liquid crystal display device, an electroluminescent display device, a micro light-emitting diode (LED) display device, and the like. The electroluminescent display device may be an organic light-emitting diode (OLED) display device, a quantum-dot light-emitting diode display device, or an inorganic light-emitting diode display device.

Referring to FIG. 1, the display device may include a display panel 100, a gate driver 200, a data driver 300, a gamma voltage generator 500, a timing controller 400, and the like. The gate driver 200 and the data driver 300 may be defined as panel drivers. The gate driver 200, the data driver 300, and the timing controller 400 may be defined as display drivers.

The display panel 100 displays an image through a display area DA in which sub-pixels P are arranged in a matrix form. Each of the sub-pixels P is one of a red sub-pixel emitting red light, a green sub-pixel emitting green light, a blue sub-pixel emitting blue light, and a white sub-pixel emitting white light, and may be independently driven by at least one thin-film transistor (TFT). A unit pixel may be configured of a combination of two, three, or four sub-pixels having different colors.

A gate electrode of the TFT belonging to each of the sub-pixels P is connected to the gate driver 200 through a gate line disposed on the display panel 100, and an input electrode of any one of a source electrode and a drain electrode of each TFT is connected to the data driver 300 through a data line disposed on the display panel 100.

In other words, in each of the sub-pixels P, while the TFT is turned on in response to a scan pulse of a gate-on voltage, which is supplied through the corresponding gate line from the gate driver 200, a pixel voltage (driving voltage) corresponding to the data signal is charged by receiving the data signal, which is supplied through the corresponding data line from the data driver 300, through the turned-on TFT and light corresponding to the charged voltage is emitted, so that a grayscale corresponding to the data signal may be expressed.

The display panel 100 may further include a touch sensor screen entirely overlapping the display area and configured to sense a touch of a user, and the touch sensor screen may be embedded in the panel 100 or disposed in the display area of the panel 100.

The timing controller 400 may receive image data and synchronization signals from a host system (not shown). For example, the host system may be any one of a computer, a TV system, a set-top box, a system of a portable terminal such as a tablet or mobile phone. The synchronization signals may include a dot clock, a data enable signal, a vertical synchronization signal, a horizontal synchronization signal, and the like.

The timing controller 400 may generate a plurality of data control signals using the received synchronization signals and timing setting information (start timing, a pulse width, and the like) stored in internal registers to supply the plurality of data control signals to the data driver 300, and generate a plurality of gate control signals to supply the plurality of gate control signals to the gate driver 200.

The timing controller 400 may perform various types of image processing such as brightness correction for reducing power consumption, image quality correction, and the like on the supplied image data, and supply the image-processed data to the data driver 300.

The gamma voltage generator 500 may generate a reference gamma voltage set including a plurality of reference gamma voltages having different voltage levels and supply the reference gamma voltage set to the data driver 300. The gamma voltage generator 500 may generate the plurality of reference gamma voltages corresponding to gamma characteristics of the display device under the control of the timing controller 400 and supply the reference gamma voltages to the data driver 300. The gamma voltage generator 500 may include a programmable gamma IC, and may receive gamma data from the timing controller 400, generate or adjust a reference gamma voltage level according to the gamma data, and output the reference gamma voltage level to the data driver 300.

The gate driver 200 is controlled according to the plurality of gate control signals supplied from the timing controller 400 to individually drive the gate lines of the display panel 100. The gate driver 200 may sequentially drive a plurality of gate lines. The gate driver 200 may supply a scan signal of a gate-on voltage to the corresponding gate line in a driving period of each of the gate lines, and supply the scan signal of a gate-off voltage to the corresponding gate line in a non-driving period of each of the gate lines.

The gate driver 200 may include at least one gate driver IC, and may be mounted on a circuit film such as a tape carrier package (TCP), a chip on film (COF), a flexible printed circuit (FPC), or the like to be attached to the display panel 100 in a tape automatic bonding (TAB) manner, or may be mounted on the display panel 100 in a chip on glass (COG) manner. Alternatively, the gate driver 200 may be formed on a TFT substrate together with the TFT belonging to each of the sub-pixels P of the display panel 100 and embedded in a bezel area of the display panel 100.

The data driver 300 may be controlled according to the data control signal supplied from the timing controller 400, and may convert the digital image data supplied from the timing controller 400 into an analog data signal, and supply the analog data signal to each of the data lines of the display panel 100. The data driver 300 may convert the digital image data into the analog data signal using grayscale voltages obtained by subdividing the plurality of reference gamma voltages supplied from the gamma voltage generator 500.

The data driver 300 may include at least one data drive IC and may be mounted on a circuit film such as a TCP, a COF, an FPC, or the like to be attached to the display panel 100 in a TAB manner, or may be mounted in the bezel area of the display panel 100 in a COG manner.

Referring to FIG. 2, the data driver 300 may include a plurality of data drive ICs D-IC1 to D-ICn connected between the timing controller (TCON) 400 and the display panel 100 and configured to divide and drive a plurality of data lines of the display panel 100.

In order to reduce the number of transmission lines and electromagnetic interference (EMI), the timing controller 400 and the plurality of data drive ICs D-IC1 to D-ICn of the display drive device may transmit and receive data through a high-speed serial interface method that converts parallel data into serial data and transmits the serial data in a point-to-point manner.

For a high-speed serial interface, the timing controller 400 may include a transmitter TX, and each of the plurality of data drive ICs D-IC1 to D-ICn may include a receiver RX, and the transmitter TX and each of a plurality of receivers RX may be connected in a point-to-point manner through a plurality of transmission channels TL1 to TLn.

The transmitter TX of the timing controller 400 may convert the serial data into a differential signal such as a low voltage differential signal (LVDS) or a mini-LVDS, and may transmit the differential signal to the receiver RX of each of the plurality of data drive ICs D-IC1 to D-ICn through each of the plurality of transmission channels TL1 to TLn. Each of the transmission channels TL1 to TLn may include one pair of lines for transmitting the differential signal, or may include a plurality of pairs of lines, for example, two or four pairs of lines. The transmitter TX may transmit only serial transmission data without a clock, or may transmit serial transmission data having a clock embedded therein.

The serial transmission data may include an N-bit image data string (where N is a positive integer) corresponding to each sub-pixel, and may include a plurality of data control signals. In addition, the serial transmission data may include a clock training pattern for locking a clock generator in the receiver RX of each of the plurality of data drive ICs D-IC1 to D-ICn, and may include a test data pattern for accurately synchronizing the clock generated by each receiver RX with the input data.

For example, the transmitter TX may serially transmit the clock training pattern to the receiver RX of each of the data drive ICs D-IC1 to D-ICn during a first period, and each receiver RX may generate a lock signal when the clock generator is locked using the input clock training pattern and generate a plurality of clocks. The lock signal may be sequentially generated from the receiver RX of each of the plurality of data drive ICs D-IC1 to D-ICn, and the lock signal generated from the receiver RX of the last data drive IC D-ICn may be transmitted to the transmitter TX of the timing controller 400.

The transmitter TX may serially transmit the test data pattern to the receiver RX of each of the data drive ICs D-IC1 to D-ICn during a second period, and each receiver RX may recover the test data pattern from the input data using the output clock of the clock generator. Each receiver RX may detect a degree of asynchronicity (shift amount) between the clock and the input data by comparing the recovered test data pattern with a predetermined reference data pattern. Each receiver RX may recover the clock accurately synchronized with the input data by controlling the output of the clock generator according to the detected degree of asynchronicity (shift amount).

The transmitter TX may transmit control information to the receiver RX of each of the data drive ICs D-IC1 to D-ICn during a third period, and transmit image data to each receiver RX during a fourth period. Each receiver RX may accurately sample and recover the data control signals from the input data using the clock synchronized with the input data, and may accurately sample and recover the image data.

The first period, during which the clock training pattern is transmitted and received, and the second period, during which the test data pattern is transmitted and received, may be included in an initial driving period before power of the display device is turned on and an image of each frame is displayed. The third period, during which the data control signals are transmitted and received, may be included in a blank period (a vertical blank period or a horizontal blank period) of each frame, and the fourth period, during which the image data is transmitted and received, may be included in an active period of each frame. Meanwhile, the first and second periods may also be included before the third period of the blank period of each frame.

Figure 3:
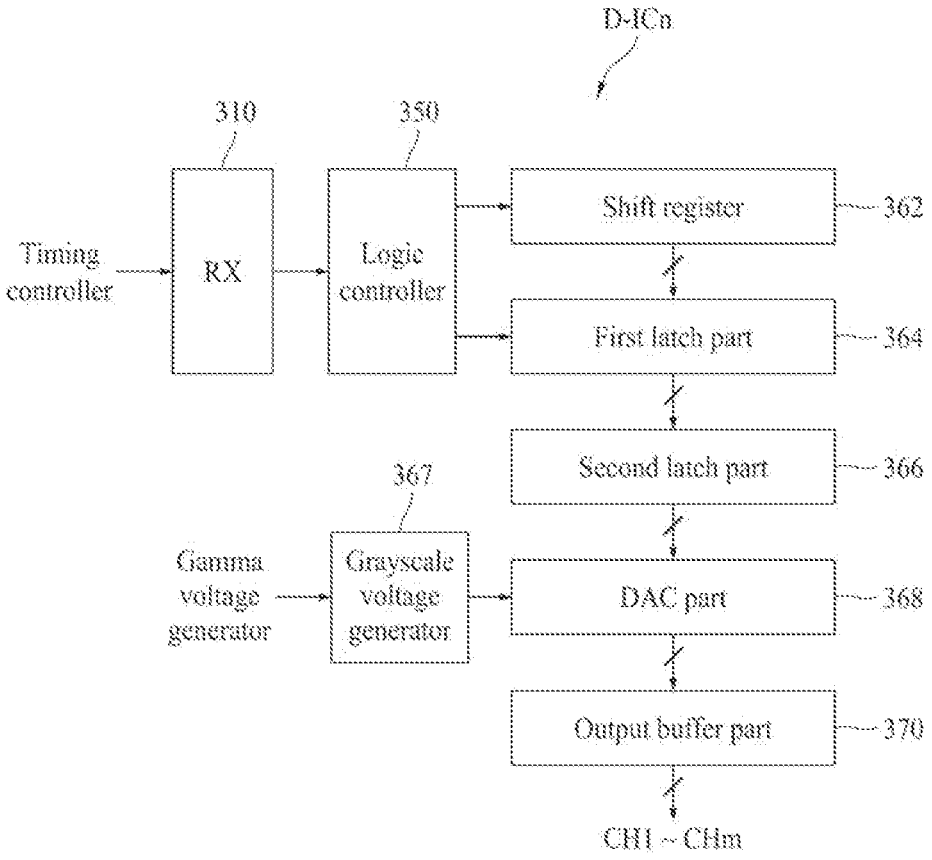
FIG. 3 is a block diagram illustrating an internal configuration of each of data drive integrated circuits (ICs) according to one embodiment.

FIG. 3 is a block diagram illustrating an internal configuration of each data drive IC according to one embodiment;

Referring to FIG. 3, each data drive IC D-ICn may include a receiver (RX) 310, a shift register 362, latch parts 364 and 366, a grayscale voltage generator 367, a digital to analog converter (DAC) part 368, and an output buffer part 370.

Each data drive IC D-ICn may supply a corresponding data signal to m (where m is a positive integer) data lines among the data lines disposed in the display panel 100 through a plurality (m) of output channels CH1 to CHm.

The receiver (RX) 310 of each data drive IC D-ICn may receive transmission signals in the form of a differential signal, which are transmitted from the timing controller 400 in a high-speed serial interface method, and may recover a clock, image data, and control signals from the input transmission signal to transmit the recovered clock, image data, and control signals to a logic controller 350.

In particular, the receiver (RX) 310 may recover the clock accurately synchronized with the input data according to the comparison result between the test data pattern transmitted from the timing controller 400 and the predetermined reference data pattern, and may accurately sample and recover the image data and the control signals using the recovered clock. A detailed clock recovery method of the receiver (RX) 310 will be described below.

The logic controller 350 may rearrange the image data of each sub-pixel unit, which is supplied from the receiver (RX) 310, according to an operation option and output the rearranged image data to a first latch part 364. The logic controller 350 may output a start pulse and a shift clock to the shift register 362 using the clock and data control signals supplied from the receiver 310, output a load signal to a second latch part 366, the output buffer part 370, and the like, and further generate and output control signals necessary for the operations of other components.

The shift register 362 may sequentially output a plurality of sampling signals to the first latch part 364 while sequentially shifting the start pulse according to the shift clock. The shift register 362 may include stages of a plurality of channels and sequentially output sampling signals of a plurality of channels to the first latch part 364 while performing a shift operation for sequentially shifting the start pulse according to the shift clock. The shift register 362 may include stages of m channels equal to the number of the output channels CH1 to CHm, and may include stages less than m stages.

The first latch part 364 may sequentially latch pieces of data of a plurality of channels, which are sequentially transmitted from the receiver 310 through a data bus, in response to the sampling signals of a plurality of channels, which are sequentially input from the shift register 362, for each channel of each sub-pixel unit, and when pieces of data of all channels are latched, the first latch part 364 may simultaneously output the latched data of each channel to the second latch part 366. The first latch part 364 may include first latches of m channels equal to the number of the output channels CH1 to CHm.

The second latch part 366 may simultaneously output the data of each channel (sub-pixel) received from the first latch part 364 to the DAC part 368 in response to the load signal supplied from the logic controller 350. The second latch part 366 may include second latches of m channels equal to the number of the output channels CH1 to CHm.

The grayscale voltage generator 367 may subdivide the reference gamma voltages supplied from the gamma voltage generator 500 into a plurality of grayscale voltages respectively corresponding to grayscale values of the image data by dividing the reference gamma voltages through a resistor string, and then output the subdivided grayscale voltages to the DAC part 368.

The DAC part 368 may convert the data of each subpixel supplied from the second latch part 366 into an analog data signal for each channel using the grayscale voltages supplied from the grayscale voltage generator 367, and output the analog data signals to the output buffer part 370. The DAC part 368 may include DACs of m channels equal to the number of the channels CH1 to CHm.

The output buffer part 370 may buffer the data signal of each sub-pixel, which is supplied from the DAC part 368, for each channel and output the buffered data signal to each of the plurality of output channels CH1 to CHm. The output buffer part 370 may include output buffers of m channels equal to the number of the output channels CH1 to CHm.

Figure 4:
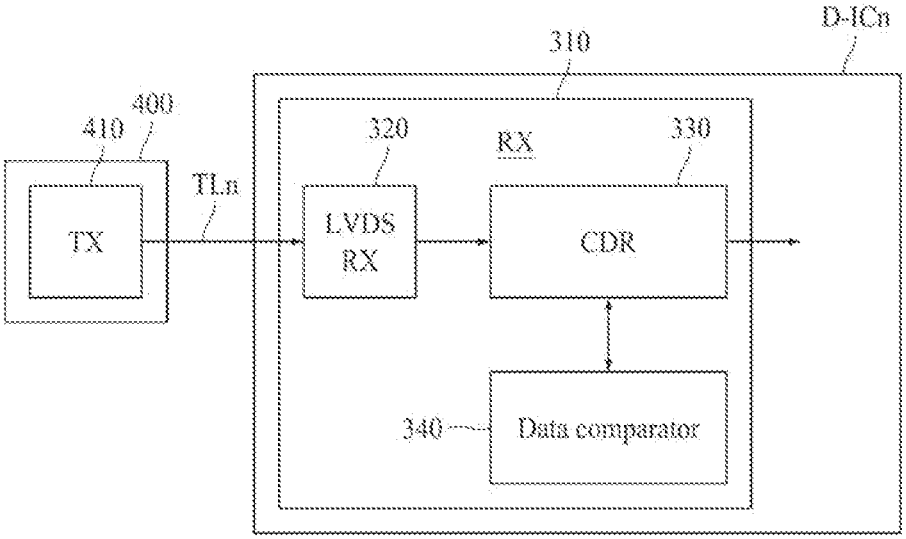
FIG. 4 is a block diagram illustrating a configuration of a transmitter and a receiver of the display drive device according to one embodiment.

FIG. 4 is a block diagram illustrating a configuration of a transmitter and a receiver of the timing controller and the data drive IC of the display drive device according to one embodiment.

Referring to FIG. 4, the receiver (RX) 310 of each data drive IC D-ICn may include an LVDS RX 320, which is a reception buffer, a clock and data recovery (CDR) part 330, and a data comparator 340.

A transmitter TX 410 of the timing controller 400 may convert the serial transmission data into a differential signal in the form of an LVDS, and transmit the differential signal to the receiver (RX) 310 of each data drive IC D-ICn through each transmission channel TLn. The serial transmission data may include the clock training pattern, the test data pattern, the control information, the image data, and the like.

The LVDS RX 320, which is a reception buffer, may receive the differential signal in the form of an LVDS transmitted through each transmission channel TLn from the transmitter TX 410 of the timing controller 400, convert the received differential signal into serial data, and output the serial data.

The CDR part 330 may generate and output a phase-locked first clock using the input clock training pattern during the first period, divide the first clock by N to generate second clocks having N different phases, and output any one of the second clocks having N phases. The CDR part 330 may generate a plurality of clocks including the first clock and the plurality of second clocks using a phase-locked loop (PLL) or a delay-locked loop (DLL) as a clock generator.

The CDR part 330 may recover the test data pattern from the input data pattern during the second period using the first clock and the second clock, and output the recovered test data pattern to the data comparator 340.

The data comparator 340 may compare a degree of asynchronicity (shift amount) between the test data pattern recovered by the CDR part 330 and the predetermined reference data pattern, generate a control signal according to the comparison result, and output the control signal to the CDR part 330.

The CDR part 330 may recover the second clock accurately synchronized with the input data by selecting and outputting any one second clock synchronized with the input data among the second clocks of N phases according to the control signal supplied from the data comparator 340.

The CDR part 330 may accurately sample and recover the data control signals from the input data during the third period using the first clock and the recovered second clock, and may accurately sample and recover the image data from the input data during the fourth period.

Figure 5:
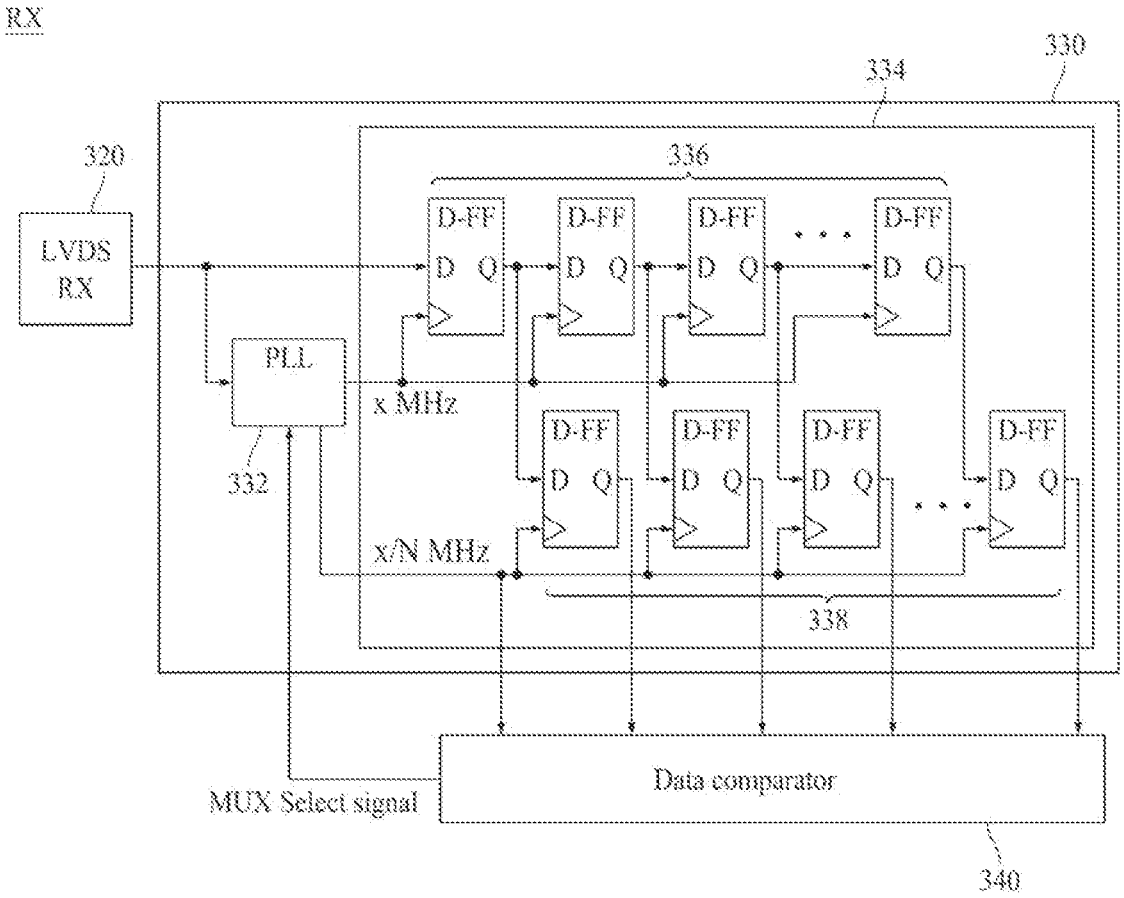
FIG. 5 is a block diagram illustrating a configuration of a receiver of the data drive IC according to one embodiment.

FIG. 5 is a block diagram illustrating a configuration of the receiver of the data drive IC, mainly the clock and data recovery part, according to one embodiment.

Referring to FIG. 5, the CDR part 330 may include a PLL 332, which is a clock generator configured to generate a plurality of clocks, and a deserializer 334 configured to convert an N-bit serial data string into parallel data.

The PLL 332 may receive the clock training pattern through the LVDS RX 320 during the first period, and generate and output a phase-locked first clock x MHz in synchronization with the clock training pattern. At the same time, the PLL 332 may divide the first clock x MHz by N to generate divided clocks of N phases, each of which has the same period as the N-bit data string and whose phases are sequentially delayed in each bit unit (a period of the first clock), and may select one second clock from the divided clocks of N phases and output the selected second clock. The PLL 332 may output the first clock x MHz to the deserializer 334, and may output a second clock x/N MHz to the deserializer 334 and the data comparator 340.

The deserializer 334 may convert the N-bit serial data string input through the LVDS RX 320 into parallel data of N bits using the output clocks x MHz and x/N MHz of the PLL 332, and output the parallel data. The deserializer 334 may output the recovered test data pattern to the data comparator 340 by converting the test data pattern, which is input during the second period, into a parallel form.

To this end, the deserializer 334 may include a first register 336 having N first D flip-flops D-FF connected in series to a data input line, and a second register 338 having N second D flip-flops D-FF connected in parallel with N-bit outputs of the first register 336.

In the first register 336, the first D flip-flops D-FF, which are serially connected, may sequentially shift the N-bit serial data string according to the first clock x MHz, which is output from the PLL 332, and output the N-bit data that has been shifted in a parallel form to the second register 338.

In the second register 338, the second D flip-flops D-FF, which are connected in parallel, may simultaneously sample and latch the N-bit data output in parallel from the first register 336 according to the second clock x/N MHz, which is output from the PLL 332, and output the latched N-bit parallel data.

The data comparator 340 may compare the test data pattern recovered through the deserializer 334 with the predetermined reference data pattern during the second period and detect a degree of asynchronicity (shift amount) between the recovered test data pattern and the reference data pattern, thereby detecting a degree of asynchronicity (shift amount) between the second clock and the input data output from the PLL 332. The data comparator 340 may generate a Mux selection signal, which is a control signal, according to the detected degree of asynchronicity, and output the Mux selection signal to the PLL 332.

The PLL 332 may select and output the second clock synchronized with the input reference data pattern from among the divided clocks of N phases according to the Mux selection signal supplied from the data comparator 340, thereby recovering the second clock x/N MHz synchronized with the input data.

The deserializer 334 may recover data control signals input as serial data during the third period by accurately sampling the data control signals using the first clock x MHz and the recovered second clock x/N MHz output from the PLL 332 and converting the data control signals into a parallel form, and output the recovered data control signals to the logic controller 350 described with reference to FIG. 3.

The deserializer 334 may recover image data input as serial data during the fourth period by accurately sampling the image data using the first clock x MHz and the recovered second clock x/N MHz output from the PLL 332, and converting the image data into a parallel form, and output the recovered image data to the logic controller 350 described with reference to FIG. 3.

Figure 6:
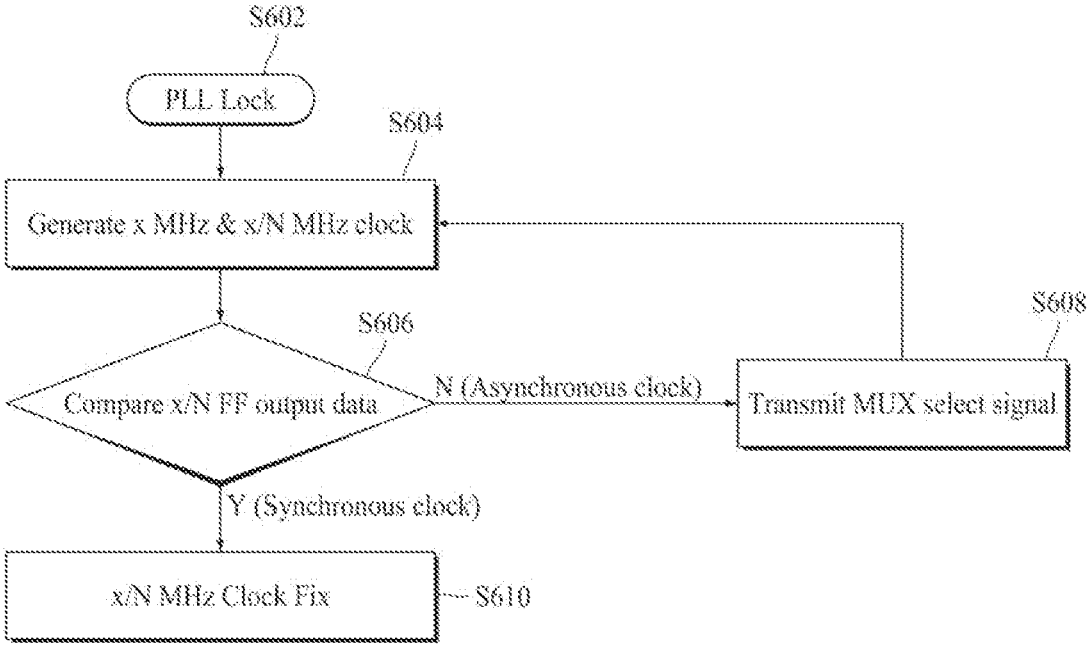
FIG. 6 is a flowchart illustrating a clock recovery method of the data drive IC according to one embodiment.
Figure 7:
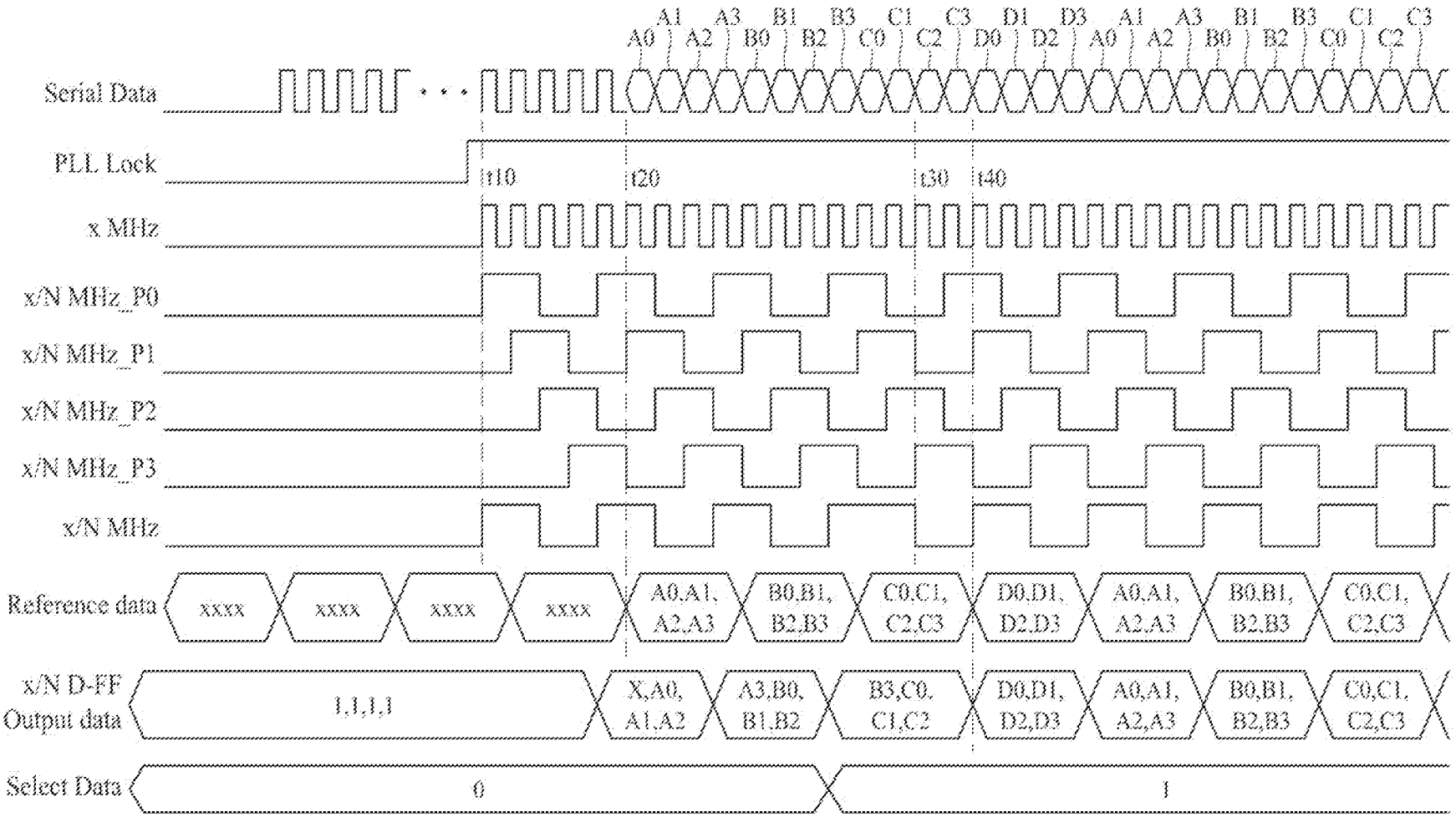
FIG. 7 is a driving waveform diagram illustrating a clock recovery operation of the receiver of the data drive IC according to one embodiment.

FIG. 6 is a flowchart illustrating a clock recovery method of the data drive IC according to one embodiment, and FIG. 7 is a driving waveform diagram illustrating a clock recovery operation of the receiver of the data drive IC according to one embodiment.

The clock recovery method illustrated in FIG. 6 and driving waveforms illustrated in FIG. 7 may be operated by the receiver RX of the data drive IC illustrated in FIG. 5, and thus will be described in conjunction with FIGS. 5 to 7.

Referring to FIGS. 5 to 7, the CDR part 330 may receive a clock training pattern input through the LVDS RX 320 from the timing controller 400 as serial data during a first period, and may receive a plurality of test data patterns A0 to A3, B0 to B3, C0 to C3, and D0 to D3 input as serial data during a second period. Each of the test data patterns A0 to A3, B0 to B3, C0 to C3, and D0 to D3 transmitted from the timing controller 400 has an N-bit string composed of N bits equal to image data and has the same pattern as a predetermined reference data pattern of the data comparator.

The PLL 332 may output a PLL lock signal of an active state (a high logic state) when a phase of a clock generated according to an input frequency is locked in synchronization with the clock training pattern input during the first period (S602).

The PLL 332 may generate and output a first clock x MHz synchronized with the clock training pattern at a first timing t10 during the first period (S604). In addition, the PLL 332 may divide the first clock x MHz by N to generate divided clocks x/N MHz_P0, x/N MHz_P1, x/N MHz_P2, and x/N MHz_P3 of N phases, each of which has a period equal to that of the N-bit string and which have different phases in each bit unit (a period of the first clock), and select a first divided clock x/N MHz_P0 according to an initial Mux selection signal (0) and output the first divided clock x/N MHz_P0 as a second clock x/N MHz (S604). The PLL 332 may output the first clock x MHz to the deserializer 334, and may output the second clock x/N MHz (=x/N MHz_P0) to the deserializer 334 and the data comparator 340.

The deserializer 334 may sample each of the test data patterns A0 to A3, B0 to B3, C0 to C3, and D0 to D3, which are sequentially input as serial data in units of an N-bit string, according to the first clock x MHz and the second clock x/N MHz (=x/N MHz_P0), which are output from the PLL 332, from a second timing t20 during the second period, and convert each of the test data patterns A0 to A3, B0 to B3, C0 to C3, and D0 to D3 into N-bit parallel data, thereby recovering the test data pattern and outputting the recovered test data pattern to the data comparator 340.

The data comparator 340 may receive the recovered test data pattern from the deserializer 334 at every period of the second clock x/N MHz (=x/N MHz_P0) output from the PLL 332 and compare the received test data pattern with the predetermined reference data pattern (S606). The reference data pattern may be preset to be the same as the test data pattern transmitted from the timing controller and stored in the data comparator 340. In FIG. 7, "reference Data" denotes the predetermined reference data pattern in the data comparator 340, and "x/N D-FF output Data" denotes the test data pattern recovered and output by the deserializer 334.

The data comparator 340 may compare the test data pattern recovered according to the second clock with the reference data pattern to detect a degree of asynchronicity (shift amount) and determine whether the second clock x/N MHz output from the PLL 332 is synchronized with the test data pattern by comparing the recovered test data pattern with the predetermined reference data pattern (S606).

When it is determined that the second clock x/N MHz (=x/N MHz_P0) of the PLL 332 is asynchronous with the test data pattern (S606, N), the data comparator 340 may generate a Mux selection signal according to the degree of asynchronicity (shift amount) between the test data pattern and the reference data pattern and output the Mux selection signal to the PLL 332 (S608).

For example, as a result of comparing test data patterns X and A0 to A2, A3 and B0 to B2, and B3 and C0 to C2, which are recovered by the deserializer 334 for each period of the second clock x/N MHz (=x/N MHz_P0) of the PLL 332, with predetermined reference data patterns A0 to A3, B0 to B3, and C0 to C3, the data comparator 340 may detect that the recovered test data patterns X and A0 to A2, A3 and B0 to B2, and B3 and C0 to C2 are shifted by one bit in comparison with the reference data patterns A0 to A3, B0 to B3, and C0 to C3, and generate a Mux selection signal (1) corresponding to the detected shift amount (the number of shifted bits) and output the Mux selection signal (1) to the PLL 332. In FIG. 7, "Select Data" denotes the Mux selection signal output from the data comparator 340.

The PLL 332 may perform an operation of converting a phase of the second clock x/N MHz according to the Mux selection signal (1), which is supplied from the data comparator 340, at a third timing t30, and select a second divided clock x/N MHz_P1 whose phase is delayed by one bit according to the Mux selection signal (1) from among the divided clocks x/N MHz_P0, x/N MHz_P1, x/N MHz_P2, and x/N MHz_P3 of N phases at a fourth timing t40 to output the second divided clock x/N MHz_P1 as the second clock x/N MHz (S604).

The deserializer 334 may convert the test data patterns A0 to A3, B0 to B3, C0 to C3, and D0 to D3, which are input as an N-bit serial data string, into a parallel form using the first clock x MHz and the second clock x/N MHz (=x/N MHz_P1) output from the PLL 332, and output the test data patterns A0 to A3, B0 to B3, C0 to C3, and D0 to D3 to the data comparator 340 as the recovered test data pattern.

When it is determined that the second clock x/N MHz (=x/N MHz_P1) of the PLL 332 is synchronized with the test data pattern (S606, Y) as a result of receiving the test data pattern output from the deserializer 334 at every period of the second clock x/N MHz (=x/N MHz_P1) output from the PLL 332 and comparing the test data pattern with the predetermined reference data pattern, the data comparator 340 may maintain the Mux selection signal (1) of the previous period.

Accordingly, the PLL 332 may maintain the second clock x/N MHz (=x/N MHz_P1) to be output by selecting and outputting the divided clock x/N MHz_P1 that is the same as that of the previous period according to the maintained Mux selection signal (1). Thus, the PLL 332 may fixedly output the second clock x/N MHz (=x/N MHz_P1) which is accurately synchronized with the input data in a subsequent period (S610).

Accordingly, during the third period and the fourth period after the second period, the deserializer 334 may convert the data control signals and the image data, which are input as serial data, into parallel data using the first and second clocks x MHz and x/N MHz output from the PLL 332, and output the parallel data.

As described above, the data drive circuit, the clock recovery method of the data drive circuit, and the display drive device according to one embodiment may detect the degree of asynchronicity (shift amount) by comparing the test data patterns, recovered from the input data using any one clock of the PLL, with a predetermined reference data pattern, recover the clock accurately synchronized with the input data by selecting the output clock in the PLL according to the detected degree of asynchronicity (shift amount), and accurately recover the input data using the recovered clock, thereby improving the internal stability of a drive system.

The data drive circuit and the display drive device including the same according to the embodiment may be applied to various electronic devices. For example, the data drive circuit and the display drive device including the same according to the embodiment may be applied to a mobile device, a video phone, a smart watch, a watch phone, a wearable device, a foldable device, a rollable device, a bendable device, a flexible device, a curved device, an electronic notebook, an e-book, a portable multimedia player (PMP), a personal digital assistant (PDA), an MPEG audio layer-3 player, a mobile medical device, a desktop personal computer (PC), a laptop PC, a netbook computer, a workstation, a navigation device, a vehicle navigation device, a vehicle display device, a television, a wallpaper display device, a signage device, a game device, a notebook computer, a monitor, a camera, a camcorder, a home appliance, and the like.

Features, structures, effects, etc. described above in various examples of the present disclosure are included in at least one example of the present disclosure and are not necessarily limited to only one example. Furthermore, features, structures, effects, etc. illustrated in at least one example of the present disclosure may be combined or modified for other examples by those skilled in the art to which the technical idea of the present disclosure pertains. Therefore, the contents related to such combinations and modifications should be interpreted as being included in the technical spirit or scope of the present disclosure.

While the present disclosure described above is not limited to the above-described embodiments and the accompanying drawings, it will be apparent to those skilled in the art to which the present disclosure belongs that various substitutions, modifications, and changes may be made herein without departing from the scope of the present disclosure. Therefore, the scope of the present disclosure is defined by the appended claims, and all changes or modifications derived from the meaning, scope, and equivalence of the claims are to be construed as being included in the scope of the present disclosure.

What is claimed is:

1. A data drive circuit comprising a receiver including:

a clock and data recovery part configured to recover a test data pattern from input data using an internal clock; and a data comparator configured to compare the recovered test data pattern with a predetermined reference data pattern to generate a control signal according to a degree of asynchronicity between the recovered test data pattern and the reference data pattern, wherein the clock and data recovery part recovers a clock synchronized with the input data according to the control signal, and recovers control information and image data from the input data using the recovered clock.

2. The data drive circuit of claim 1, wherein the clock and data recovery part includes:

a clock generator configured to output a first clock according to an input frequency, and a second clock, which is selected from among a plurality of divided clocks divided from the first clock and having different phases, according to the control signal of the data comparator; and a deserializer configured to convert the input data in a serial form into parallel data using the first clock and the second clock and output the parallel data.

3. The data drive circuit of claim 2, wherein the clock generator is configured to:

generate and output the first clock whose phase is locked in synchronization with a clock training pattern supplied as the input data; and divide the first clock to have a period the same as that of an N-bit image data string (where N is an integer equal to or greater than two), generate N divided clocks having different phases, and select and output a second clock from among the N divided clocks according to the control signal of the data comparator.

4. The data drive circuit of claim 3, wherein the deserializer recovers the test data pattern by shifting the input test data pattern in a serial form, which is supplied as the input data, according to the first clock, latching the shifted test data pattern according to the second clock, and outputting the latched test data pattern in a parallel form.

5. The data drive circuit of claim 3, wherein the deserializer includes:

a first register including N first flip-flops connected in series to a data input line, and configured to shift the input test data pattern, which is input in units of an N-bit string, according to the first clock; and a second register including N second flip-flops connected in parallel to the N first flip-flops, and configured to latch the test data pattern of N bits, which is from the first register, according to the second clock and output the latched test data pattern in a parallel form.

6. The data drive circuit of claim 3, wherein the data comparator compares the recovered test data pattern with the reference data pattern, detects the number of shifted bits of the recovered test data pattern in comparison with the reference data pattern as the degree of asynchronicity, generates the control signal for selecting one of the N divided clocks according to the detected degree of asynchronicity, and outputs the control signal to the clock generator.

7. The data drive circuit of claim 1, wherein the receiver is configured to:

generate the internal clock using a clock training pattern in a serial form transmitted from the timing controller during a first period;

recover the test data pattern in a serial form, which is transmitted from the timing controller without a clock during a second period, to the test data pattern in a parallel form using the internal clock, and recover a clock synchronized with the input data using the recovered test data pattern;

recover the control information in a serial form, which is transmitted from the timing controller without a clock during a third period, to the control information in a parallel form using the recovered clock; and recover image data in a serial form, which is transmitted from the timing controller without a clock during a fourth period, to the image data in a parallel form using the recovered clock.

8. The data drive circuit of claim 7, wherein the first period and the second period are included in an initial driving period before the image data of each frame is supplied, the third period is included in a blank period of each frame, and the fourth period is included in an active period of each frame.

9. The data drive circuit of claim 8, wherein the first and second periods are further included before the third period of the blank period of each frame.

10. The data drive circuit of claim 1, wherein the receiver further includes a reception buffer configured to receive a transmission signal in the form of a differential signal from a transmitter of a timing controller through a transmission channel, convert the transmission signal into the input data, and output the input data to the clock and data recovery part.

11. A clock recovery method of a data drive circuit, the clock recovery method comprising:

recovering a test data pattern from input data using an internal clock;

comparing the recovered test data pattern with a predetermined reference data pattern to generate a control signal according to a shift amount between the recovered test data pattern and the reference data pattern; and recovering a clock synchronized with the input data by selecting any one clock from among a plurality of clocks, which have different phases, included in the internal clock according to the control signal.

12. The clock recovery method of claim 11, further comprising, before the recovering of the test data pattern, generating the internal clock including a first clock and a second clock, wherein in the generating of the internal clock, the first clock whose phase is locked in synchronization with a clock training pattern transmitted from the timing controller is generated, the first clock is divided to have a period the same as that of an N-bit image data string (where N is an integer equal to or greater than two) to generate N divided clocks having different phases, and one of the divided clocks is output as the second clock.

13. The clock recovery method of claim 12, wherein the recovering of the test data pattern includes:

shifting the input test data pattern in a serial form, which is supplied as the input data, according to the first clock; and recovering the test data pattern by latching the shifted test data pattern according to the second clock and outputting the latched test data pattern in a parallel form.

14. The clock recovery method of claim 12, wherein the generating of the control signal includes:

comparing the recovered test data pattern with the reference data pattern and detecting the number of shifted bits of the recovered test data pattern in comparison with the reference data pattern as the shift amount; and generating the control signal for selecting the second clock from among the N divided clocks according to the detected shift amount.

15. A display drive device comprising:

a timing controller including a transmitter; and a plurality of data drive circuits each including a receiver connected to the transmitter of the timing controller through each transmission channel, wherein the receiver includes:

a clock and data recovery part configured to recover a test data pattern from input data transmitted from the transmitter using an internal clock; and a data comparator configured to compare the recovered test data pattern with a predetermined reference data pattern to generate a control signal according to a shift amount between the recovered test data pattern and the reference data pattern, wherein the clock and data recovery part recovers a clock synchronized with the input data according to the control signal, and recovers control information and image data from the input data using the recovered clock.

16. The display drive device of claim 15, wherein the clock and data recovery part includes:

a clock generator configured to generate and output a first clock whose phase is locked in synchronization with a clock training pattern transmitted from the transmitter, divide the first clock to have a period the same as that of an N-bit image data string (where N is an integer equal to or greater than two), generate N divided clocks having different phases, and select and output a second clock from among the N divided clocks according to the control signal of the data comparator; and a deserializer configured to convert the input data in a serial form into parallel data using the first clock and the second clock and output the parallel data, wherein the deserializer recovers the test data pattern by shifting the input test data pattern in a serial form, which is supplied as the input data, according to the first clock, latching the shifted test data pattern according to the second clock, and outputting the latched test data pattern in a parallel form.

17. The display drive device of claim 16, wherein the data comparator compares the recovered test data pattern with the reference data pattern, detects the number of shifted bits of the recovered test data pattern in comparison with the reference data pattern as the shift amount, generates the control signal for selecting the second clock from among the N divided clocks according to the detected shift amount, and outputs the control signal to the clock generator.

18. The display drive device of claim 15, wherein the receiver is configured to:

generate the internal clock using a clock training pattern in a serial form transmitted from the transmitter during a first period;

recover the test data pattern in a serial form, which is transmitted from the transmitter without a clock during a second period, to the test data pattern in a parallel form using the internal clock, and recover a clock synchronized with the input data using the recovered test data pattern;

recover the control information in a serial form, which is transmitted from the transmitter without a clock during a third period, to the control information in a parallel form using the recovered clock; and recover the image data in a serial form, which is transmitted from the transmitter without a clock during a fourth period, to the image data in a parallel form using the recovered clock.

19. The display drive device of claim 18, wherein the first period and the second period are included in an initial driving period before the image data of each frame is supplied, the third period is included in a blank period of each frame, the fourth period is included in an active period of each frame, and the first and second periods are further included before the third period of the blank period of each frame.

20. The display drive device of claim 15, wherein the transmitter of the timing controller transmits a transmission signal in the form of a differential signal through each transmission channel, and the receiver receives the transmission signal in the form of a differential signal, converts the received signal into the input data, and outputs the input data to the clock and data recovery part.

* * * * *